US007617546B1

(12) United States Patent
Hill

(10) Patent No.: US 7,617,546 B1
(45) Date of Patent: Nov. 17, 2009

(54) DISABLED PERSON SWIMMING POOL USAGE SYSTEM

(76) Inventor: Jimmy Hill, 4480 Old Guernsey Rd., Pace, FL (US) 32571

( * ) Notice: Subject to any disclaimer, the term of this patent is extended or adjusted under 35 U.S.C. 154(b) by 838 days.

(21) Appl. No.: 11/360,785

(22) Filed: Feb. 22, 2006

(51) Int. Cl.
*E04H 4/00* (2006.01)

(52) U.S. Cl. ..... 4/496

(58) Field of Classification Search ..... 4/496, 4/560.1–566.1; 5/81.1 R, 86.1, 81.1 HS
See application file for complete search history.

(56) References Cited

U.S. PATENT DOCUMENTS 4,283,803 A * 8/1981 Krumbeck ..... 4/496
4,630,709 A * 12/1986 Taylor ..... 182/48
5,373,591 A * 12/1994 Myers ..... 4/560.1
6,182,304 B1 * 2/2001 Freeberg ..... 4/560.1

* cited by examiner

*Primary Examiner*—Huyen Le
(74) *Attorney, Agent, or Firm*—Peter Loffler

(57) ABSTRACT

A system helps a disabled person more fully utilize a swimming pool by transporting the person over the pool water and lowering the person toward the water for entry thereinto. The device uses a base that has a lift platform that is capable of being raised and lowered as well as rotated. The base is at least partially submerged within the pool and has a stairway abutting it. Three separate platforms extend outwardly from the base and rest on the pool deck. Each platform has a rail system thereon which is traversable by a chair that rides on the rail systems. Transition between out rail and another is accomplished at the lift platform which operates similar to a railway roundhouse turntable.

13 Claims, 2 Drawing Sheets

DISABLED PERSON SWIMMING POOL USAGE SYSTEM

BACKGROUND OF THE INVENTION

1. Field of the Invention

The present invention relates to a swimming pool usage system that allows physically challenged persons to be able to sit over a pool as well as to be positioned proximate an in-pool stairway system for easy entry into and exit out of the pool.

2. Background of the Prior Art

Swimming pools are a great source of fun and relaxation on a hot summer day. Lying around the deck and basking in the sun sure feel good and when its get too hot, a jump into the cool swimming pool water is truly refreshing. The swimming pool is a great source of fun and comfort especially during the long lazy days of summer. However, physically challenged people, especially those who have little or no control or ability of their lower extremities, may not be able to truly enjoy the marvels of the swimming pool. Such people, due to their inability to be able to easily get into and out of the pool, may only be able to enjoy the swimming pool from the sidelines, that is strictly on the swimming pool deck. While others are splashing and playing, such folks can only sit on the deck and look on.

To address such issues, various devices have been proposed that assist the physically challenged in getting into and out of swimming pools so that such persons can enjoy the soothing cool waters afforded by the pool. The problem with such devices is that many tend to only lift a person into and out of the pool at a particular spot and do not assist the person in traversing more than a small section of the pool. While such devices allow a person to enjoy the water, these devices tend to lock a person in place within the pool and prevent greater mobility about and enjoyment of the pool. Other devices have been proposed that allow a more robust usage of the swimming pool, however, such devices tend to be extremely complex in design and construction making them prohibitively expensive for all but a few potential users.

What is needed is a device that allows a physically challenged person to be able to use a swimming pool in more than just a very restricted fashion. Such a device must not only allow a person to enter and exit the water with relative ease, but must also allow the person to traverse at least a good portion of the swimming pool water area to give the person a sense of freedom and mobility. Such a device must not be unduly complex in design and construction so that the device is affordable to many potential users.

SUMMARY OF THE INVENTION

The disabled person swimming pool usage system of the present invention addresses the aforementioned needs in the art. The person swimming pool usage system is a device that allows a physically challenged person to be able to use a swimming pool in more than just a very limited fashion. The present invention allows a disabled person to enter and exit the water with relative ease while also allowing the person to traverse at least a good portion of the swimming pool water area thereby giving the person a sense of freedom and mobility about the pool. The disabled person swimming pool usage system is not unduly complex in design and construction making the device reasonably affordable to many potential users.

The disabled person swimming pool usage system of the present invention is comprised of a base member that has a top surface and an underside. A first platform extends outwardly from the base and has a first rail system thereon, while a second platform extends outwardly from the base and has a second rail system thereon, while a third platform extends outwardly from the base and has a third rail system thereon that is longitudinally aligned and spaced apart from the second rail system. A lift platform is attached to the base member and has a connector rail system thereon. The lift platform is capable of articulating between a lowered position resting on the top surface of the base and a raised position. The lift platform is also capable of rotating between a first position wherein the connector rail adjoins the first rail system whenever the lift platform is in the raised position and a second position wherein the connector rail railably adjoins either the second rail system or the third rail system whenever the lift platform is in a raised position allowing railable traverse between the various rail systems. A chair is capable of riding along the first rail system, the second rail system, the third rail system, and the connector rail system. A stairway platform abuts against a first side of the base member opposite the first platform. The stairway platform has an upper surface that is generally located on the same plane as the plane of the top surface of the base member. A pair of guide fins extends outwardly from the first side of the base member such that the stairway platform receives the guide fins for proper positioning of the stairway platform with respect to the base member. The articulation and the rotation of the lift platform are each controlled by a remote control device. The second platform is telescoping and has an adjustable stop attached to its underside. The third platform is also telescoping and also has a stop attached its underside. A first height adjustable leg is attached to a first underside of the first platform, a second height adjustable leg is attached to a second underside of the second platform, a third height adjustable leg attached to a third underside of the third platform, a fourth height adjustable leg attached to a fourth underside of the base member, and a fifth height adjustable leg attached to a fifth underside of the stairway platform. The base member is at least partially submerged under water such that the lift platform is raised and lowered by a hydraulic cylinder that operates with a working fluid. The hydraulic cylinder uses the water within which the base member is submerged as this working fluid.

BRIEF DESCRIPTION OF THE DRAWINGS

Similar reference numerals refer to similar parts throughout the several views of the drawings.

DESCRIPTION OF THE PREFERRED EMBODIMENT

Figure 1:
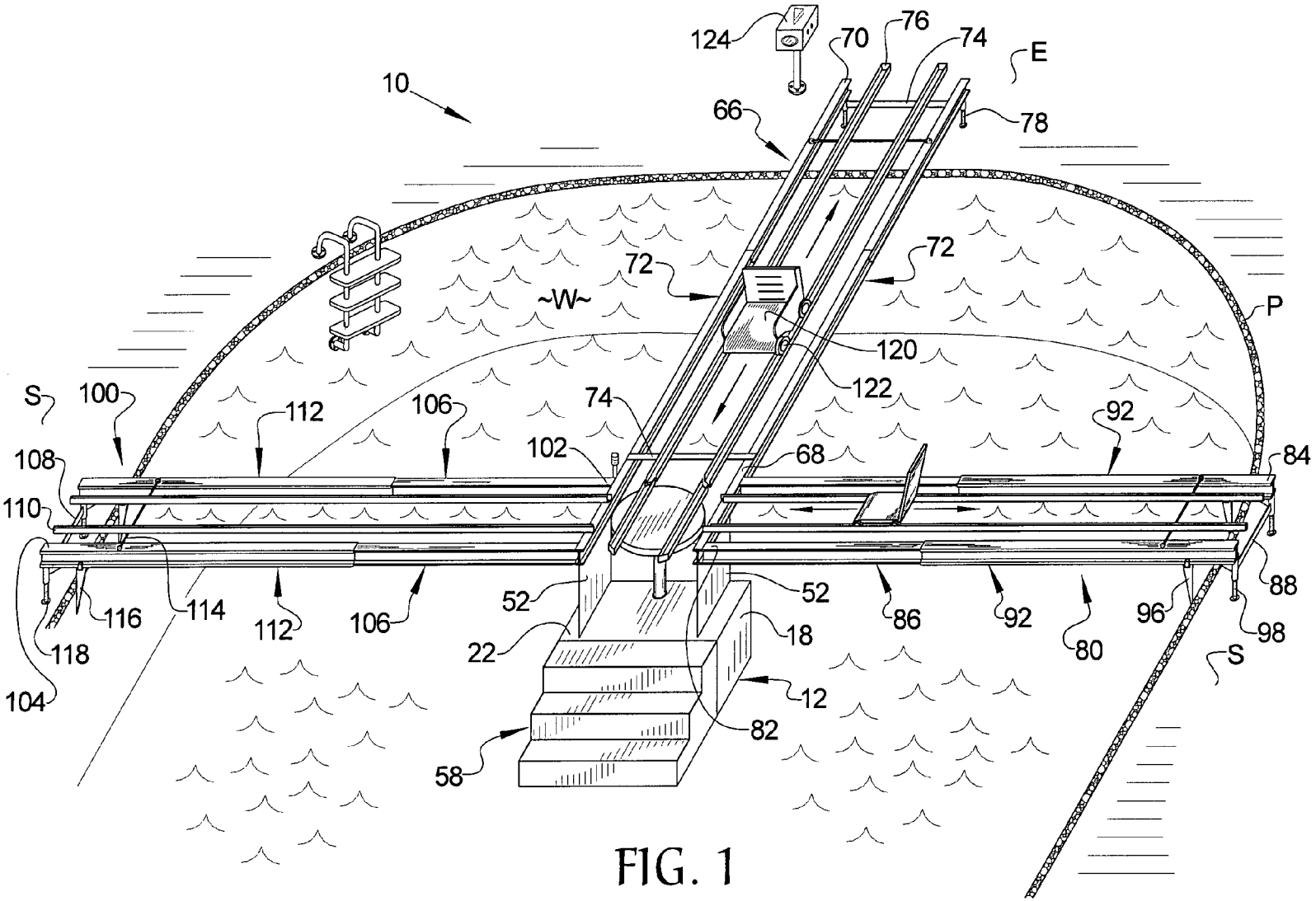
FIG. 1 is a perspective environmental view of the disabled person swimming pool usage system of the present invention.

Referring now to the drawings, it is seen that the disabled person swimming pool usage system of the present invention, generally denoted by reference numeral 10, is comprised of a base member 12 that has a first side 14, a second side 16 opposite the first side 14, a third side 18 connecting the first side 14 and the second side 16, and a fourth side 20, also connecting first side 14 and the second side 16 and located opposite the third side 18. The base member 12 also has a top surface 22 and an underside 24. A series of height adjustable legs 26 extend downwardly from the underside 24 of the base member 12. The legs 26 are height adjustable in any appropriate manner known in the art. A pair of guide fins 28 extends outwardly from the first side 14 of the base member 12. Located within the interior of the base member 12 is a hydraulic cylinder 30. The hydraulic cylinder 30 uses water W as its working fluid and has a ram 32 extending outwardly therefrom. The ram 32 protrudes through an opening 34 located on the top surface 22 of the base member 12. An inlet port 36, located on the first side 14 (or any of the other sides 16, 18, or 20, or even the underside 24) of the base member 12, is provided as is an outlet port 38. A pump 40 is disposed between the inlet port 36 and the outlet port 38 and draws water W through the inlet port 36 and provides the working fluid to the hydraulic cylinder 30 in order to control the raising and lowering of the ram 32. A fluid flow control valve 42 is interposed between the inlet port 36 and the hydraulic cylinder 30 while a second fluid flow control valve 44 is interposed between the hydraulic cylinder 30 and the outlet port 38, each of the valves 42 and 44, helping control, in conjunction with the pump 40, the fluid pressure within the hydraulic cylinder 30. A swivel motor 46 is also disposed within the interior of the base member 12 and connects to the ram 32 via an appropriate rotation drive wheel 48 in order to rotate and counter-rotate the ram 32. A remote control receiver 50 is located within the interior chamber of the base member 12, which remote control receiver 50 receives appropriate remote control signals to activate the hydraulic cylinder 30 and the swivel motor 46. The receiver 50 receives power from an appropriate electrical source (none illustrated). This source may be a battery disposed within the interior chamber of the base member 12 or may be an external source, such as a 12 volt DC source, to which the system 10 is wired. Additionally, a solar collector can be used as the source of electrical power and/or as a source of trickle down electrical charging of the battery used. The base member 12 is appropriately sealed so that water W does not enter the interior chamber. A plurality of risers 52 extend upwardly from the top surface 22 of the base member 12 proximate the second side 16, the third side 18, and the fourth side 20.

Figure 2:
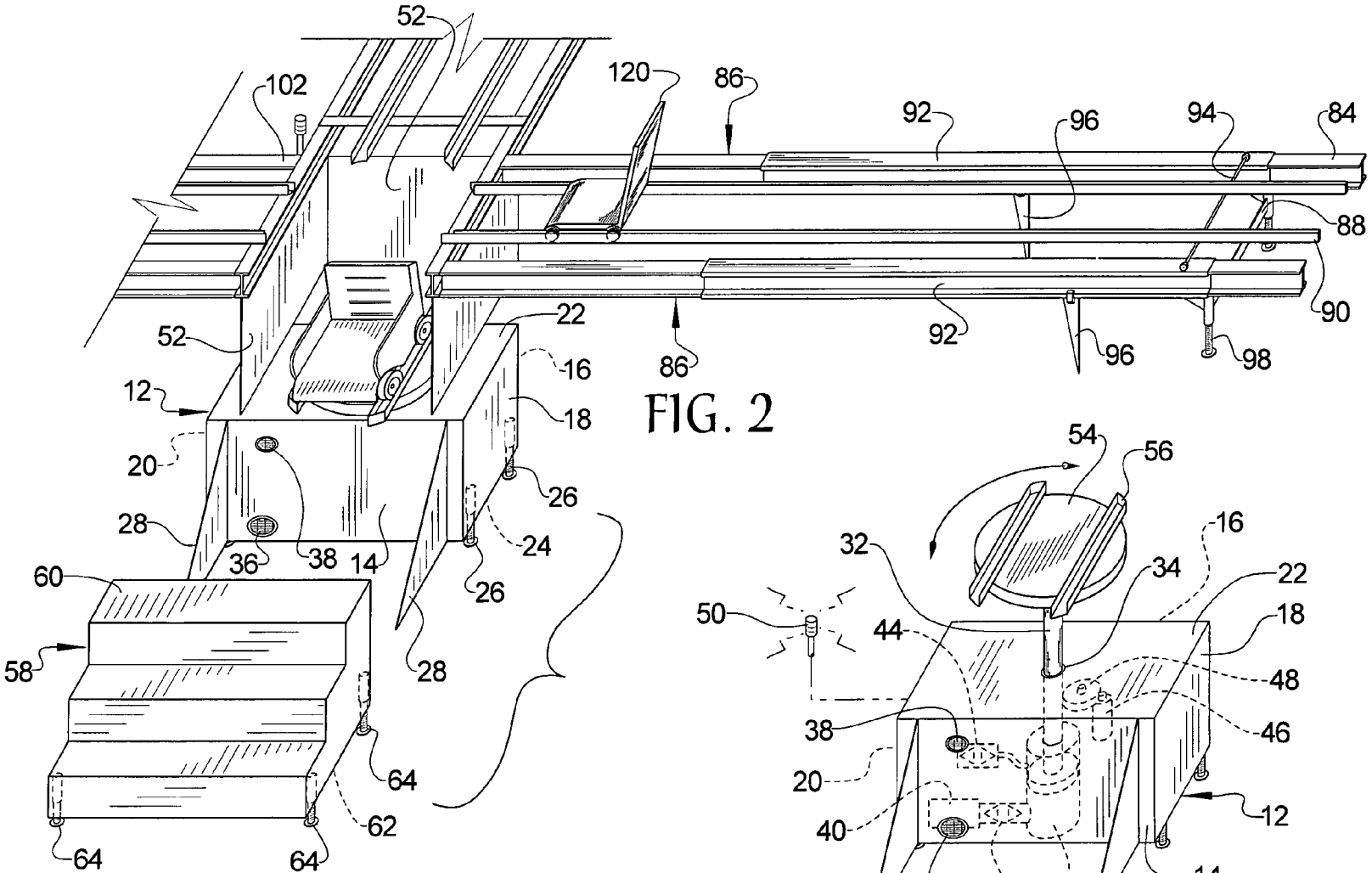
FIG. 2 is a perspective view of the swimming pool entry subsystem of the disabled person swimming pool usage system.
Figure 3:
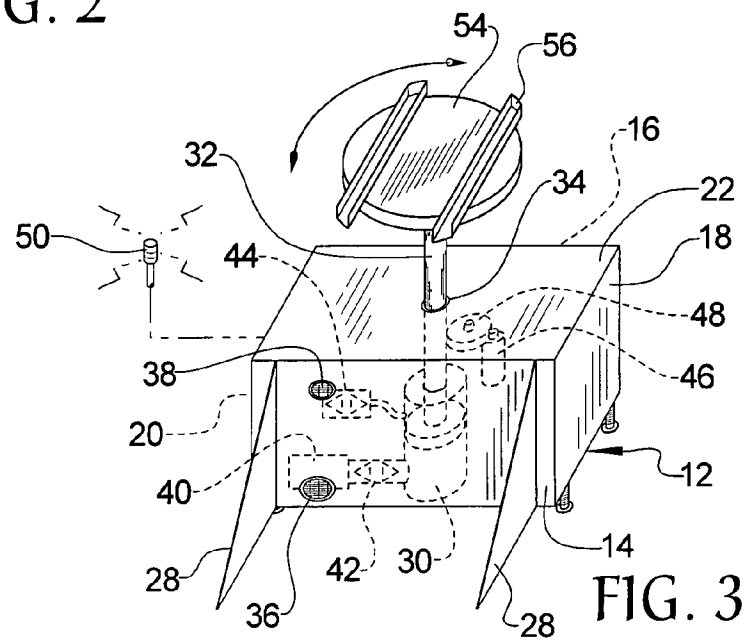
FIG. 3 is a detail view of the base member and lifting platform.

A lift platform 54 is located atop the distal end of the ram 32. A connector rail system 56 is located on the lift platform 54. The lift platform 54 is capable of articulating, via the raising and the lowering of the ram 32 by the hydraulic cylinder 30 respectively, between a raised position extended above the top surface 22 of the base member 12, as best illustrated in FIGS. 1 and 3, and a lowered position wherein the lift platform 54 sits just atop the top surface 22 of the base member 12, as best illustrated in FIG. 2.

A stairway platform 58 is positionable in abutting relationship with the first side 14 of the base member 12 such that appropriate receivers (not illustrated) are provided on the stairway platform 58 such that the receivers receive the guide fins 28 for proper positioning of the stairway platform 58 with respect to the base member 12. The stairway platform 58 has an upper surface 60 and an underside 62. When the stairway platform 58 is properly positioned with respect to the base member 12, the upper surface 60 of the stairway platform is generally located on the same plane as the plane of the top surface 22 of the base member 12. A series of height adjustable legs 64 extend downwardly from the underside 62 of the stairway platform 58. These legs 64 are also height adjustable in any appropriate manner known in the art.

A first platform 66 has a first end 68 that sits atop the riser 52 proximate the second side 16 of the base member 12 and a second end 70. As seen, the first platform 66 comprises a pair of I-beams 72 that are coextensive with one another and are connected by a series of cross members 74. A first rail system 76 extends between the first end 68 and the second end 70 of the first platform 66 and sits atop the cross members 74. A series of height adjustable legs 78 extend downwardly from the underside of the first platform 66. These legs 78 are also height adjustable in any appropriate manner known in the art.

A second platform 80 has a third end 82 that sits atop the riser 52 proximate the third side 18 of the base member 12 and a fourth end 84. As seen, the second platform 80 comprises a pair of I-beams 86 that are coextensive with one another and are connected by one or more cross members 88. A second rail system 90 extends between the third end 82 and the fourth end 84 of the second platform 80 and sits atop the cross members 88. Each I-beam 86 of the second platform 80 has a sleeve 92 that is slidably disposed on the respective I-beam 86. A roller 94 extends between the sleeves 92 and allows for the slidable movement of the sleeves 92. The sleeves 92 allow the second platform 80 to be telescopically extendable in length. Each sleeve 92 has an adjustable stop 96 that extends downwardly from and is positionable along the length of its respective sleeve 92. A series of height adjustable legs 98 extend downwardly from the underside of the second platform 80. These legs 98 are also height adjustable in any appropriate manner known in the art.

A third platform 100 has a fifth end 102 that sits atop the riser 52 proximate the fourth side 20 of the base member 12 and a sixth end 104. As seen, the third platform 100 comprises a pair of I-beams 106 that are coextensive with one another and are connected by one or more cross members 108. A third rail system 110 extends between the fifth end 102 and the sixth end 104 of the third platform 100 and sits atop the cross members 108. The third rail system 110 is longitudinally aligned with and spaced apart from the second rail system 90. Each I-beam 106 of the third platform 100 has a sleeve 112 that is slidably disposed on the respective I-beam 106. A roller 114 extends between the sleeves 112 and allows for the slidable movement of the sleeves 112. The sleeves 112 allow the third platform 100 to be telescopically extendable in length. Each sleeve 112 has an adjustable stop 116 that extends downwardly from and is positionable along the length of its respective sleeve 112. A series of height adjustable legs 118 extend downwardly from the underside of the third platform 100. These legs 118 are also height adjustable in any appropriate manner known in the art.

The first platform 66 may be telescoping in similar fashion to that of the second platform 80 and the third platform 100.

One or more chairs 120 having appropriate wheels 122 are capable of riding along the various rail systems 56, 76, 90, and 110. The first platform 66 is positioned such that when the lift platform 54 is in the raised position and is appropriately rotated so that the rail connector system 56 is aligned with the first rail system 76, the two rail systems 56 and 76 are railably connected allowing a chair 120 to smoothly transition between the two rail systems 56 and 76. Similarly, the second platform 80 and the third platform 100 are each appropriately positioned so that when the lift platform 54 is in the raised position and is appropriately rotated so that the rail connector system 56 is aligned with the second rail system 90 or the third rail system 110 (the two rail systems 90 and 110 are longitudinally aligned) the connector rail 56 railably aligns with either the second rail system 90 or the third rail system 110 allowing railable traverse between the second rail system 90 or the third rail system 110 by rotating the lift platform 54 180 degrees or with the first rail system 76 by rotating the lift platform 54 90 degrees. A stop on the end of the rail connector system 56 prevents traversal between the second rail system 90 and the third rail system 110 without 180 degree rotation of the lift platform 54.

A remote control transmitter 124 is provided for controlling the hydraulic cylinder 30 and the swivel motor 46. The remote control transmitter 124 may be the illustrated fixed position transmitter or may be a handheld portable transmitter, or both.

In order to use the disabled person swimming pool usage system 10 of the present invention, the base member 12 is positioned within the water W of a typical swimming pool P. The base member 12 may be either partially or completely submerged within the water W. If needed, the various components within the base member 12, the pump 40, the first fluid control valve 42, the second fluid control valve 44, the swivel motor 46, and the remote control receiver 50, are connected to the source of electrical power. The stairway platform 58 is appropriately positioned against the first side 14 of the base member 12. The height of the base member 12 is adjusted as needed by its legs 26 while the height of the stairway platform 58 is adjusted as needed by its legs 64. The first end 68 of the first platform 66 is positioned on its respective riser 52 while the second end 70 of the first platform 66 is positioned on an end E of the swimming pool P and its height is adjusted as needed by its legs 78. The third end 82 of the second platform 80 is positioned on its respective riser 52 while the fourth end 84 of the second platform 80 is positioned on a side S of the swimming pool P. If needed, the length of the second platform 80 is lengthened as needed by extending the sleeves 92 outwardly. The stops 96 are set so that they just abut a sidewall of the swimming pool P in order to prevent further extension of the sleeves 92. The fourth end 84 of the second platform is height adjusted as needed by its legs 98. The fifth end 102 of the third platform 100 is positioned on its respective riser 52 while the sixth end 104 of the third platform 100 is positioned on the opposing side S of the swimming pool P relative to the second platform 80. If needed, the length of the third platform 100 is lengthened as needed by extending the sleeves 112 outwardly. The stops 116 are set so that they just abut a sidewall of the swimming pool P in order to prevent further extension of the sleeves 112. The sixth end 104 of the third platform is height adjusted as needed by its legs 118. One or more chairs 120 are positioned on one or more of the rail systems 56, 76, 90, and/or 110. One of the chairs 120 is brought to the second end 70 of the first platform 66. A person gets into the chair, either alone or with assistance, and rides the chair 120 along the first rail system 76. The chair 120 may be motorized for such traverse. The lift platform 54 is raised and rotated so that the connector rail system 56 is railably connected with the first rail system 76. Once the person reaches the connector rail system 56, the person goes upon the connector rail system 56 with the chair 120. Once the chair 120 is on the connector rail system 56, the lift platform 54 may be lowered so that the person can easily transfer from the chair 120 to the stairway platform 58 and get into and use the swimming pool P as desired. When the person is finished using the swimming pool P, the person goes back up the stairway platform 58 and gets back into the chair 120. The lift platform 54 is raised until the rail connectors system 56 is railably connected with the first rail system 76 and the person rides the chair 120 back to the second end 70 of the first platform 66. Alternately, when the person on the chair 120 first comes upon the rail connector system 56, the lift platform 54 is either rotated or counterrotated so that the rail connector system 56 is railably connected with the second rail system 90 and the third rail system 110, and the person rides the chair 120 along either the second rail system 90 and the third rail system 110. Once finished, the person rides the chair 120 back to the rail connector system 56, and the lift platform 54 is rotated so that the rail connector system 56 is railably connected with the first rail system 76 and the person rides the chair 120 back to the second end 70 of the first platform 66 for dismount. Several chairs 120 can operate on the system 10 at any given time. The use of I-beams for the various platforms allows a person to have as much underneath water exposure as possible while giving the device 10 sufficient strength. Operation of the various components, the hydraulic cylinder 30 for lifting and lowering the lift platform 54 as well as the swivel motor 46 for rotating the lift platform 54, and the locomotion of the chair 120 if so provided with such capability, is all controlled by the remote control transmitter 124. If the device 10 comes with both a handheld remote transmitter 124 and a fixed transmitter 124, then the handheld transmitter 124 can be used by persons who have sufficient dexterity in one hand so as to be able to effectively operate the transmitter 124, while the fixed transmitter is used by persons who so lack such dexterity, the fixed transmitter 124 being operated by a second person at the transmitter 124.

While the invention has been particularly shown and described with reference to an embodiment thereof, it will be appreciated by those skilled in the art that various changes in form and detail may be made without departing from the spirit and scope of the invention.

I claim:

1. A swimming pool usage system comprising:

a base member having a top surface;

a first platform extending outwardly from the base and having a first rail system thereon;

a second platform extending outwardly from the base and having a second rail system thereon;

a third platform extending outwardly from the base and having a third rail system thereon that is longitudinally aligned and spaced apart from the second rail system;

a lift platform attached to the base member and having a connector rail system thereon, the lift platform capable of articulating between a lowered position resting on the top surface of the base and a raised position and wherein the lift platform is capable of rotating between a first position wherein the connector rail adjoins the first rail system whenever the lift platform is in the raised position and a second position wherein the connector rail railably adjoins either the second rail system or the third rail system whenever the lift platform is in a raised position; and a chair that is capable of riding along the first rail system, the second rail system, the third rail system, and the connector rail system.

2. The swimming pool usage system as in claim 1 further comprising a stairway platform abutting against a first side of the base member opposite the first platform, the stairway platform having an upper surface that is generally located on the same plane as the plane of the top surface of the base member.

3. The swimming pool usage system as in claim 2 further comprising a pair of guide fins extending outwardly from the first side of the base member such that the stairway platform receives the guide fins for proper positioning of the stairway platform with respect to the base member.

4. The swimming pool usage system as in claim 1 wherein the articulation and the rotation of the lift platform are each controlled by a remote control device.

5. The swimming pool usage system as in claim 1 wherein the second platform is telescoping.

6. The swimming pool usage system as in claim 5 further comprising an adjustable stop attached to an underside of the second platform.

7. The swimming pool usage system as in claim 5 wherein the third platform is telescoping.

8. The swimming pool usage system as in claim 7 further comprising a first adjustable stop attached to a first underside of the second platform.

9. The swimming pool usage system as in claim 8 further comprising a second adjustable stop attached to a second underside of the third platform.

10. The swimming pool usage system as in claim 1 further comprising:

a first height adjustable leg attached to a first underside of the first platform;

a second height adjustable leg attached to a second underside of the second platform; and a third height adjustable leg attached to a third underside of the third platform.

11. The swimming pool usage system as in claim 10 further comprising a fourth height adjustable leg attached to a fourth underside of the base member.

12. The swimming pool usage system as in claim 11 further comprising a fifth height adjustable leg attached to a fifth underside of the stairway platform.

13. The swimming pool usage system as in claim 1 wherein the base member is at least partially submerged under water and wherein the lift platform is raised and lowered by a hydraulic cylinder that operates with a working fluid, the hydraulic cylinder using the water within which the base member is submerged as the working fluid.

* * * * *